US008371145B1

(12) United States Patent
Chen et al.

(10) Patent No.: US 8,371,145 B1
(45) Date of Patent: Feb. 12, 2013

(54) YARN CONVEYING SYSTEM FOR CIRCULAR KNITTING MACHINES

(75) Inventors: Shih-Chi Chen, New Taipei (TW); Jenq-Huey Shyu, New Taipei (TW); Hsueh-Chen Fu, New Taipei (TW)

(73) Assignee: Pai Lung Machinery Mill Co., Ltd., New Taipei (TW)

( * ) Notice: Subject to any disclaimer, the term of this patent is extended or adjusted under 35 U.S.C. 154(b) by 0 days.

(21) Appl. No.: 13/331,143

(22) Filed: Dec. 20, 2011

(51) Int. Cl.
*D04B 15/40* (2006.01)

(52) U.S. Cl. ..... 66/125 R

(58) Field of Classification Search ..... 66/10, 81, 66/125 R, 146
See application file for complete search history.

(56) References Cited

U.S. PATENT DOCUMENTS

| | | | | | |
|---|---|---|---|---|---|
| 2,166,494 | A * | 7/1939 | Hiller | 66/81 |
| 2,664,006 | A * | 12/1953 | Lund | 66/81 |
| 3,762,185 | A * | 10/1973 | Schmidt et al. | 66/125 R |
| 3,777,512 | A * | 12/1973 | Burnet et al. | 66/125 R |
| 3,780,541 | A * | 12/1973 | Haynes | 66/125 R |
| 3,818,725 | A * | 6/1974 | Sakuragawa et al. | 66/62 |
| 3,858,416 | A * | 1/1975 | White et al. | 66/132 R |
| 3,901,050 | A * | 8/1975 | Schur et al. | 66/5 |
| 4,043,154 | A * | 8/1977 | Merkle | 66/125 R |
| 4,270,368 | A * | 6/1981 | Ragoza et al. | 66/13 |
| 4,440,353 | A * | 4/1984 | Shelton et al. | 242/366.2 |
| 4,512,373 | A * | 4/1985 | Trost | 139/11 |
| 4,540,138 | A * | 9/1985 | Gutschmit | 242/131 |
| 4,977,758 | A * | 12/1990 | Muir | 66/27 |
| 5,058,398 | A * | 10/1991 | Memminger et al. | 66/132 R |
| 5,285,821 | A * | 2/1994 | Fredriksson | 139/452 |
| 5,327,749 | A * | 7/1994 | Junger | 66/125 R |
| 7,370,464 | B2 * | 5/2008 | Barea | 57/261 |
| 7,533,545 | B2 * | 5/2009 | Mele et al. | 66/84 A |
| 7,802,749 | B2 * | 9/2010 | Chadwick | 242/560 |
| 7,806,360 | B2 * | 10/2010 | Chadwick | 242/560 |
| 2009/0139271 | A1 * | 6/2009 | Barea | 66/125 R |

* cited by examiner

*Primary Examiner* — Danny Worrell
(74) *Attorney, Agent, or Firm* — Muncy, Geissler, Olds & Lowe, PLLC

(57) ABSTRACT

A yarn conveying system includes a circular knitting machine, at least one yarn conveying tray and a control unit electrically connected to the circular knitting machine and yarn conveying tray. The circular knitting machine has a needle cylinder and at least one yarn feeder arranged annularly on the needle cylinder. The yarn conveying tray is wound by at least two separate yarns and includes a driving device to drive the yarn conveying tray rotating so that the yarns are supplied via a yarn conveying path to the yarn feeder. The control unit generates a yarn feeding signal to the circular knitting machine to control yarn feeding speed and a driving signal to the driving device to control rotational speed of the yarn conveying tray. Thus users can operate the control unit to control speed of the yarns supplied from the yarn conveying tray to the yarn feeder.

8 Claims, 4 Drawing Sheets

YARN CONVEYING SYSTEM FOR CIRCULAR KNITTING MACHINES

FIELD OF THE INVENTION

The present invention relates to a yarn conveying system for circular knitting machines and particularly to an active yarn conveying system for circular knitting machines.

BACKGROUND OF THE INVENTION

Denim is a coarse weave cotton cloth widely used on wear-resistant fabric for working and fashion clothes. The conventional technique of producing denim is winding a great number of warp yarns (such as 6000 pieces) on a single yarn beam and dyeing the yarns with Indigo, and coloring via a reducing agent to form an indigo color on the warp yarns.

In general, the dyed indigo warp yarns wound on the yarn beam are woven via a shuttle loom. As the shuttle loom weaves the yarns, the yarn beam is drawn by the yarns to passively supply the warp yarns. Namely, the yarn beam is driven to rotate by the drawing force of the yarns woven on the shuttle loom. Although the yarn beam is quite heavy, the weaving speed of the shuttle loom slows down and a great number of the warp yarns are drawn at the same time, broken yarns caused by the tension of the warp yarns drawing the yarn beam are seldom. However, as the shuttle loom has a relatively slow weaving speed, production of denim is limited.

SUMMARY OF THE INVENTION

The primary object of the present invention is to solve the problem of the conventional technique of weaving warp yarns via the shuttle loom that results in lower fabric production.

To achieve the foregoing object, the present invention provides a yarn conveying system for circular knitting machines that includes a circular knitting machine, at least one yarn conveying tray and a control unit electrically connected to the circular knitting machine and yarn conveying tray. The circular knitting machine has a needle cylinder and at least one yarn feeder arranged annularly on the needle cylinder. The yarn conveying tray is wound by at least two separate yarns and includes a driving device to drive the yarn conveying tray rotating so that the yarns are supplied via a yarn conveying path to the yarn feeder. The control unit generates a yarn feeding signal sent to the circular knitting machine to control the yarn feeding speed and a driving signal sent to the driving device to control the rotational speed of the yarn conveying tray.

In one embodiment the driving device drives the yarn conveying tray rotating according to the driving signal so that the yarns wound on the yarn conveying tray are supplied at a selected yarn conveying speed to the yarn feeder. The yarn conveying speed is the same as the yarn feeding speed of the circular knitting machine.

In one embodiment the control unit generates the driving signal according a set yarn feeding speed to determine the rotational speed of the yarn conveying tray.

Another object of the invention is to regulate the tension of the yarns on the yarn conveying path during knitting operation of the circular knitting machine.

To achieve the foregoing object, the invention provides at least one yarn buffer device electrically connected to the control unit on the yarn conveying path.

In one embodiment the yarn buffer device outputs a first buffer signal according to the tension of the yarns on the yarn conveying path to the control unit to adjust the rotational speed of the yarn conveying tray driven by the driving device.

In one embodiment the yarn buffer device has at least one moving element coupled on each yarn and at least one movement detection device to detect the positions of the moving element. The movement detection device is electrically connected to the control unit.

In one embodiment the movement detection device predetermines a movement detection range corresponding to the moving element and includes a first sensor located at an upper limit of the movement detection range and a second sensor located at a lower limit of the movement detection range. In the event that the moving element moves beyond the movement detection range, the first sensor or the second sensor generates a second buffer signal to the control unit.

In one embodiment the first sensors and second sensors of different moving elements generate a shut-down signal to the control unit upon detecting different moving elements respectively moving beyond the upper limit and lower limit of the movement detection range.

In one embodiment the movement detection device includes at least one third sensor located between the first and second sensors. Multiple third sensors of different moving elements detect the positions of different moving elements and send the detected positions to the control unit. The control unit calculates an average position of all moving elements and compares with an initial position stored in the control unit to regulate the rotational speed of the yarn conveying tray driven by the driving device.

The yarn conveying system according to the invention provides a driving device on the yarn conveying tray to actively supply yarn to the yarn feeder of the circular knitting machine, thereby can knit warp yarns via the circular knitting machine. Moreover, by providing the control unit that is electrically connected to the circular knitting machine and driving device to regulate the yarn conveying speed of the yarn conveying tray synchronous with the yarn feeding speed of the yarn feeder of the circular knitting machine, the broken warp yarns caused by different speeds can be reduced. In addition, by providing the yarn buffer device on the yarn conveying path to normally detect the tension of the warp yarns to feed back and regulate the yarn conveying speed, the quality of fabrics can be ensured without being affected by too great or too little tension. Compared with the conventional tension sensor, the yarn buffer device of the invention provides individual yarn conditions to the control unit, thereby can accurately control the tension of the yarn.

The foregoing, as well as additional objects, features and advantages of the invention will be more readily apparent from the following detailed description, which proceeds with reference to the accompanying drawings.

DETAILED DESCRIPTION OF THE PREFERRED EMBODIMENTS

Figure 1:
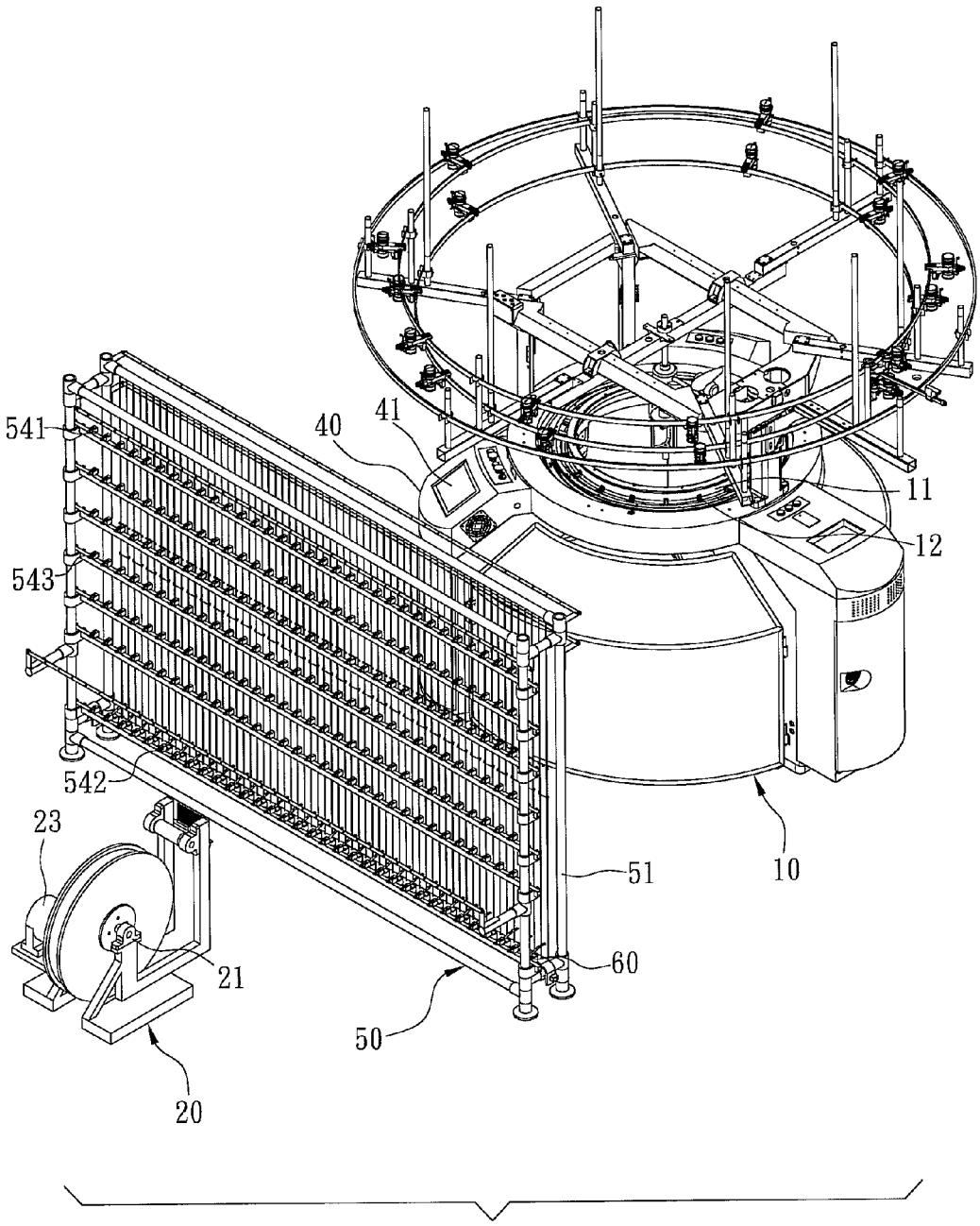
FIG. 1 is a schematic view of the structure of an embodiment of the yarn conveying system of the invention.
Figure 2:
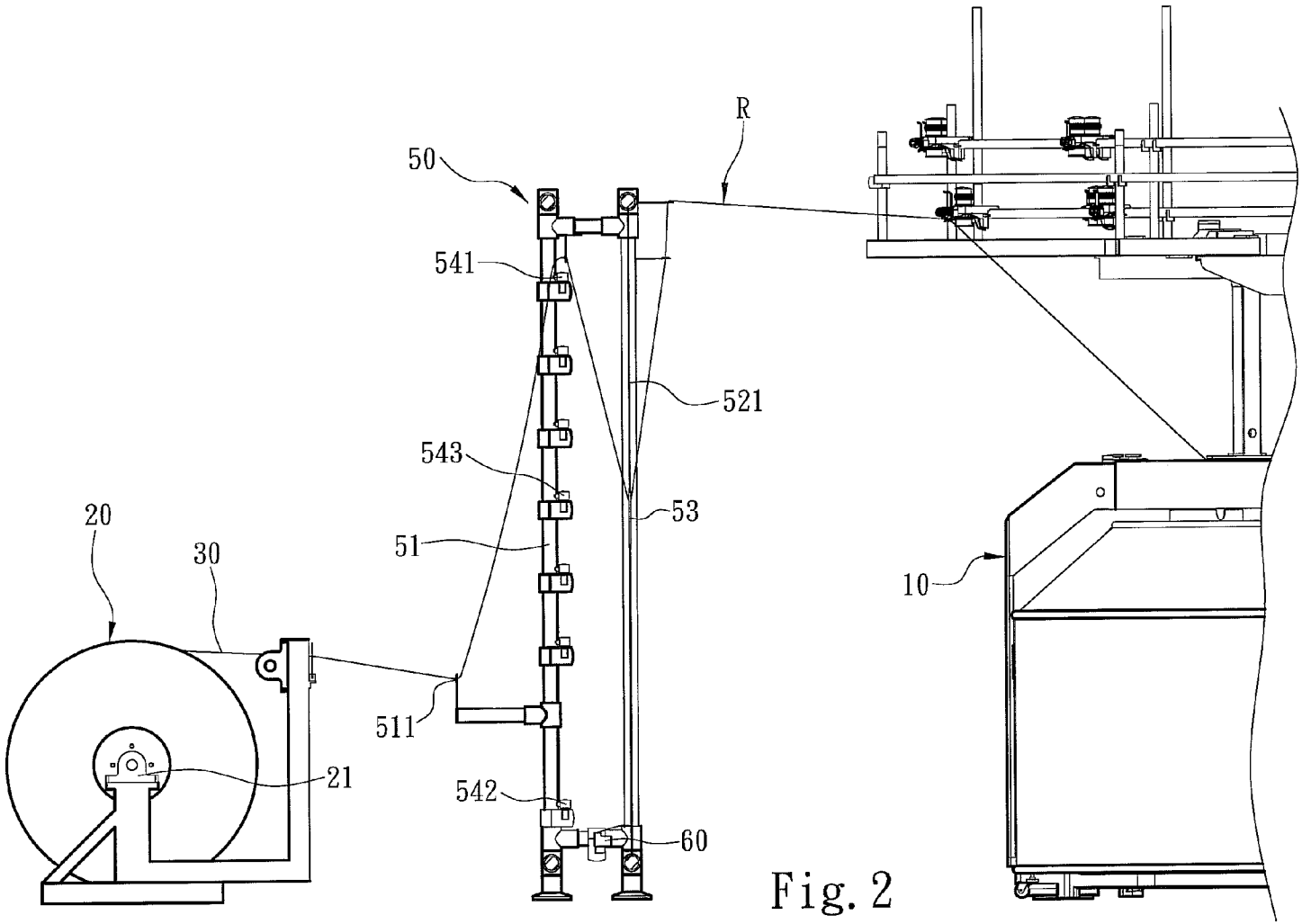
FIG. 2 is a schematic side view of the structure of an embodiment of the yarn conveying system of the invention.
Figure 3:
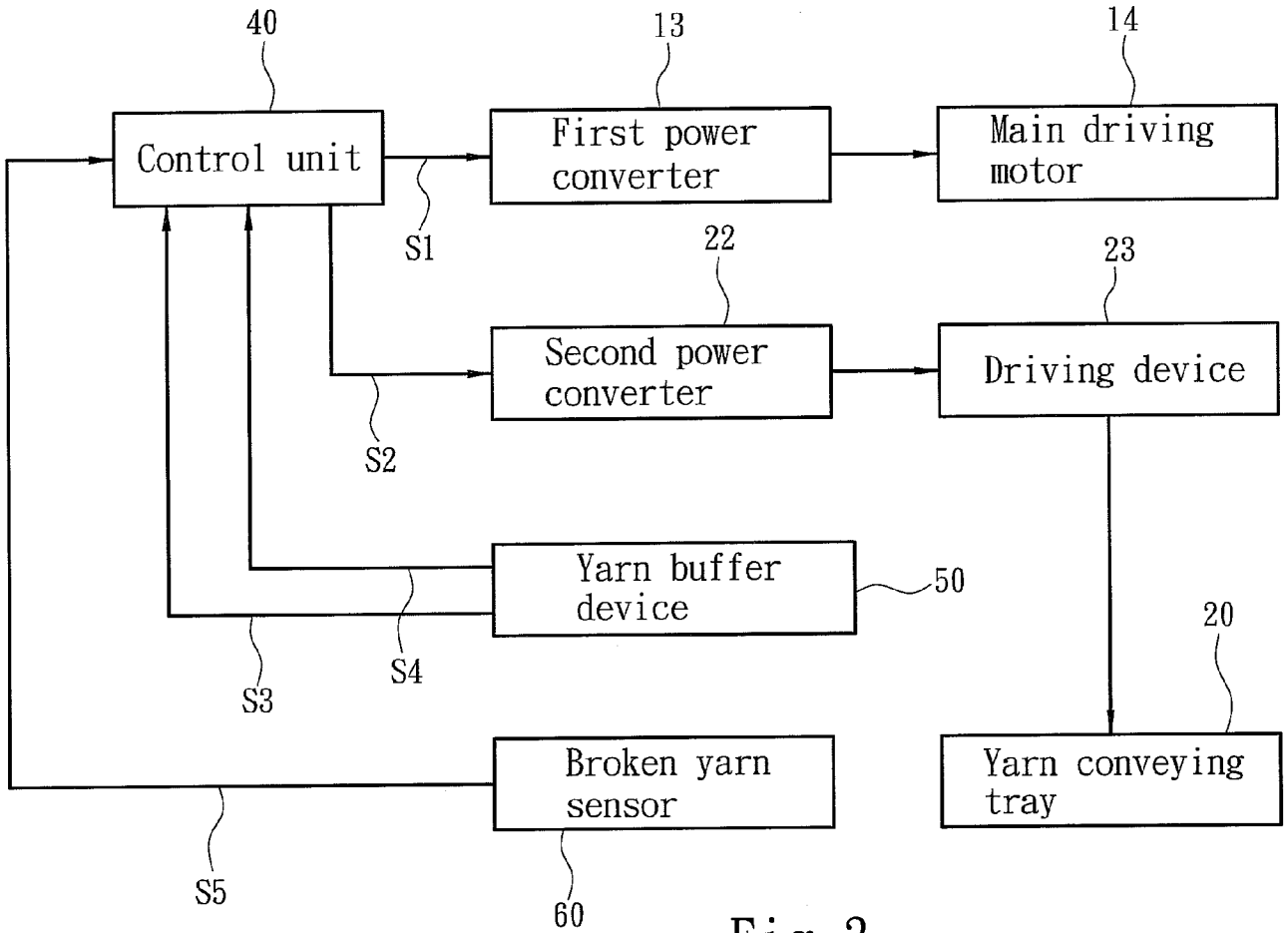
FIG. 3 is a structural block diagram of an embodiment of the invention.

Please refer to FIGS. 1, 2 and 3 for an embodiment of the yarn conveying system of the invention. It is used on a circular knitting machine 10 which includes a needle cylinder 11 and at least one yarn feeder 12 arranged annularly on the needle cylinder 11. The circular knitting machine 10 further has a first power converter 13 and a main driving motor 14 receiving power output from the first power converter 13 to drive the yarn feeder 12 to perform yarn knitting. The first power converter 13 may be a DC to AC transformer.

In this embodiment, the circular knitting machine 10 also has a control unit 40 electrically connected to the first power converter 13 to output a yarn feeding signal S1 according to setting to the first power converter 13 to control the yarn feeding speed of the yarn feeder 12 driven by the main driving motor 14. The control unit 40 includes an operation interface 41 to receive user's input commands. The operation interface 41 can be a keyboard or a touch screen. The control unit 40, aside from installed on the circular knitting machine 10 as this embodiment does, can also be independently located outside the circular knitting machine 10 by connecting to the first power converter 13 via a power cord.

The invention also includes at least one yarn conveying tray 20 to supply yarns 30 to the circular knitting machine 10. The yarn conveying tray 20 is wound by at least two separate yarns 30. The number of the yarns 30 can be adjusted according to the number of the yarn feeder 12. In this embodiment, each yarn conveying tray 20 holds at least 32 individual yarns 30. Namely, the yarns 30 wound on the yarn conveying tray 20 can be supplied simultaneous to the yarn feeder 12 for knitting. The yarn conveying tray 20 in this invention to supply multiple warp yarns 30 also is called a yarn beam. To facilitate rotation of the yarn conveying tray 20, a bearing rack 21 is provided at one side of the yarn conveying tray 20. Compared with the yarn barrel to supply the yarns in the conventional circular knitting machine, the yarn conveying tray 20 is formed at a larger size and a heavier weight. To prevent the yarns 30 from breaking caused by too great tension while being drawn merely by the circular knitting machine 10 to drive the yarn conveying tray 20 during knitting operation, referring to FIG. 3, the bearing rack 21 has a second power converter 22 and a driving device 23 located thereon to receive power output from the second power converter 22. The driving device 23 actively drives the yarn conveying tray 20 rotating so that the yarns 30 can be supplied to the yarn feeder 12 via a yarn conveying path R as shown in FIG. 2. The driving device 23 can be an AC motor. The second power converter 22 can be a DC to AC transformer. The control unit 40 is electrically connected to the second power converter 22 and transmits a driving signal S2 to the second power converter 22 to regulate the power output therefrom to the driving device 23, thereby to control the rotational speed of the yarn conveying tray 20. The driving device 23 drives the yarn conveying tray 20 rotating based on the driving signal S2 so that the warp yarns 30 wound on the yarn conveying tray 20 are supplied to the yarn feeder 12 at a desired yarn conveying speed. In this embodiment, output of the yarns 30 from the yarn conveying tray 20 is synchronous with input of the yarn feeder 12; namely, the yarn conveying speed of the yarns 30 on the yarn conveying tray 20 is the same as the yarn feeding speed of the yarn feeder 12. In the aforesaid embodiment, the control unit 40 is electrically connected to the circular knitting machine 10 and driving device 23, or also can be independently connected to the driving device 23, namely merely one driving signal S2 is output to the driving device 23 to control the rotational speed of the yarn conveying tray 20.

Referring to FIG. 3, the yarn conveying speed of the yarns 30 on the yarn conveying tray 20 and yarn feeding speed of the yarn feeder 12 can be controlled instantly by users via the control unit 40 or via preset operation parameters entered into the control unit 40 in advance, thereby to set the circular knitting machine 10 and driving device 23 so that the control unit 40 generates the yarn feeding signal S1 and the driving signal S2 and sends to the circular knitting machine 10 and driving device 23. Another alternative is providing a preset algorithm in the control unit 40 to generate a driving signal S2 to drive the yarn conveying tray 20 rotating at the desired rotational speed according to a set yarn feeding signal S1 that controls the yarn feeding speed.

In order to stably control the tension of the yarns 30 supplied to the circular knitting machine 10, the yarn conveying system of the invention further includes at least one yarn buffer device 50 on the yarn conveying path R of each yarn 30 that is electrically connected to the control unit 40 as shown in FIG. 2. In this embodiment, referring to FIGS. 1, 2 and 4, the yarn buffer device 50 mainly includes a frame 51 with a plurality of parallel movement tracks 52 located thereon, a moving element 53 located on each movement track 52 and coupled on each yarn 30, and at least one movement detection device to detect the positions of the moving element 53. The frame 51 has at least one yarn eyelet 511 threaded through by the yarn 30 in a confined yarn conveying direction. Each moving element 53 has at least one holding portion 531 at one side. The movement track 52 has a steel wire 521 threaded through the holding portion 531 to move the moving element 53 vertically. The movement detection device predetermines a movement detection range P corresponding to the positions of the moving element 53, and includes a first sensor 541 located at an upper limit of the movement detection range P and a second sensor 542 located at a lower limit of the movement detection range P. The first and second sensors 541 and 542 are electrically connected to the control unit 40.

When the tension of any yarn 30 increases, the moving element 53 coupled thereon is moved upwards on the movement track 52. In the event that the moving element 53 moves beyond the upper limit of the movement detection range P and is detected by the first sensor 541, the first sensor 541 generates a second buffer signal S3 to the control unit 40 which controls the driving device 23 to increase the rotational speed of the yarn conveying tray 20. On the other hand, when the tension of any yarn 30 decreases, the moving element 53 coupled thereon is moved downwards on the movement track 52. In the event that the moving element 53 moves beyond the lower limit of the movement detection range P and is detected by the second sensor 542, the second sensor 542 generates another second buffer signal S3 to the control unit 40 which controls the driving device 23 to decrease the rotational speed of the yarn conveying tray 20. To prevent too much tension difference between different yarns 30, when the first and second sensors 541 and 542 of different moving elements 53 detect at the same time that the different moving elements 53 respectively moves beyond the upper and lower limits of the movement detection range P, a shut-down signal S4 is generated to the control unit 40.

In addition, in order to detect the position of the moving element 53 more precisely, the movement detection device also includes at least one third sensor 543 between the first and second sensors 541 and 542. Multiple third sensors 543 are arranged along the movement detection range P to get the position of the moving element 53. Multiple third sensors 543 detect the positions of different moving elements 53 and send the detected positions to the control unit 40 which calculates an average position of all moving elements 53 and compares with an initial position stored therein, and then outputs the driving signal S2 to the driving device 23 to regulate the rotational speed of the yarn conveying tray 20.

Figure 4:
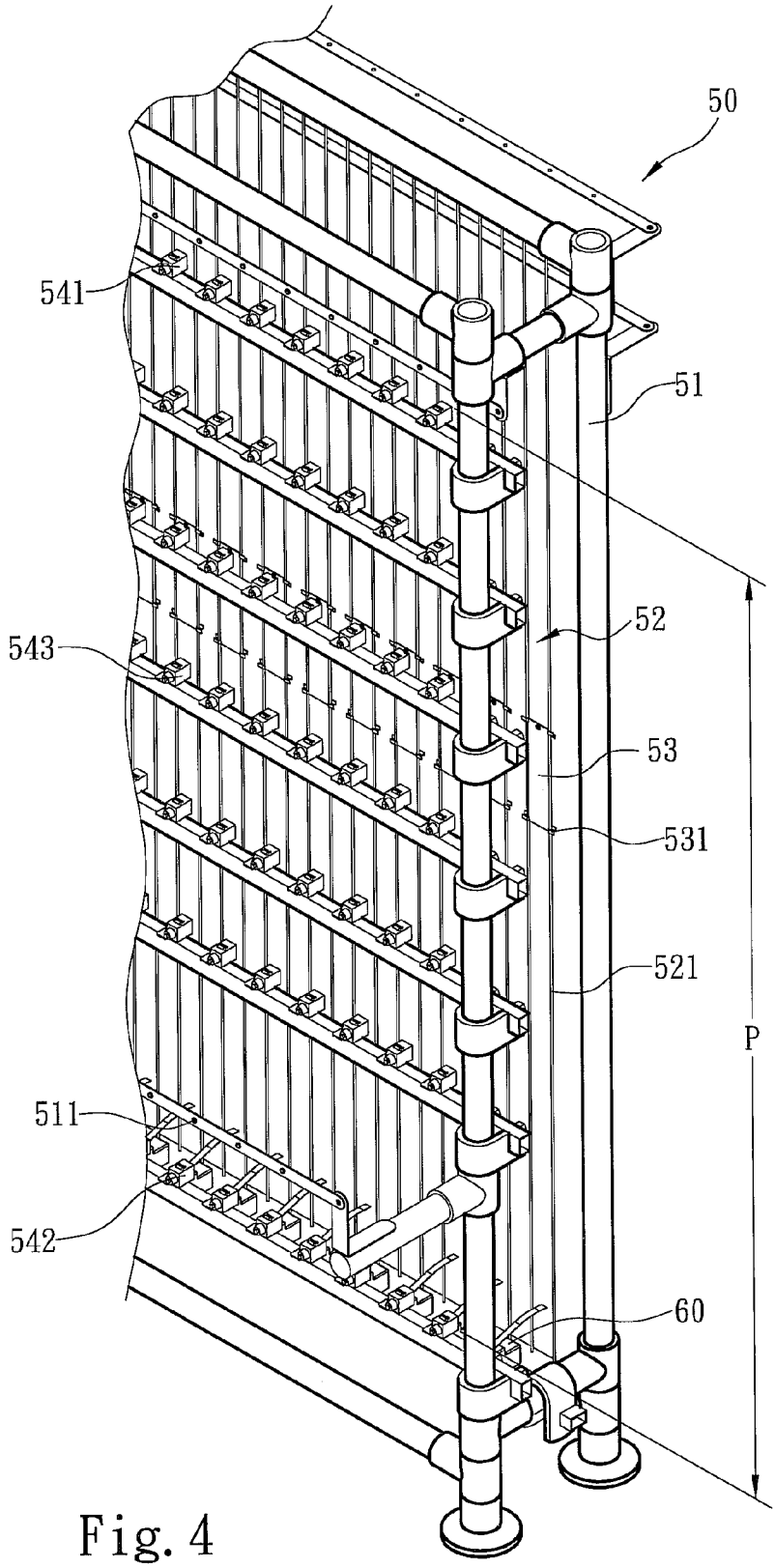
FIG. 4 is a fragmentary enlarged view of an embodiment of the yarn buffer device of the invention.

To avoid the circular knitting machine from rotating idly caused by broken yarns to result in defective finished fabric products, the yarn conveying system of the invention further includes a broken yarn sensor 60 on the frame 51 of the yarn buffer device 50 corresponding to each yarn 30 as shown in FIG. 4. The broken yarn sensor 60 is electrically connected to the control unit 40, and located below the moving element 53, and can be triggered by the moving element 53 to generate a shut-down signal S5 to the control unit 40.

As a conclusion, the yarn conveying system for circular knitting machines of the invention employs the yarn conveying tray used in the conventional shuttle loom to the circular knitting machine. The yarn conveying tray can actively supply multiple separate yarns via a driving device to the circular knitting machine to prevent the yarns from breaking caused by insufficient drawing force of the yarns to draw the yarn conveying tray during knitting operation. By providing the control unit that is electrically connected to the circular knitting machine and driving device of the yarn conveying tray to regulate the rotational speed of the yarn conveying tray, the yarn conveying speed of the yarns on the yarn conveying tray can be regulated to synchronize with the yarn feeding speed of the yarn feeder of the circular knitting machine. Moreover, to ensure the quality of finished fabric products, the yarn buffer device is provided on the yarn conveying path to detect the tension of the yarns and feed back a first buffer signal to the control unit based on the tension of the yarns to instantly regulate the rotational speed of the yarn conveying tray to maintain the tension of the yarns as desired. Thus the invention provides significant improvements over the conventional techniques.

While the preferred embodiments of the invention have been set forth for the purpose of disclosure, modifications of the disclosed embodiments of the invention as well as other embodiments thereof may occur to those skilled in the art. Accordingly, the appended claims are intended to cover all embodiments which do not depart from the spirit and scope of the invention.

What is claimed is:

1. A yarn conveying system for circular knitting machines, comprising;

a circular knitting machine including a needle cylinder and at least one yarn feeder arranged annularly on the needle cylinder;

at least one yarn conveying tray which is wound by at least two separate yarns and includes a driving device to drive the yarn conveying tray rotating to supply the yarns via a yarn conveying path to the yarn feeder;

a control unit which is electrically connected to the driving device and generates a driving signal sent to the driving device to control rotational speed of the yarn conveying tray; and at least one yarn buffer device electrically connected to the control unit on the yarn conveying path.

2. The yarn conveying system of claim 1, wherein the driving device drives the yarn conveying tray rotating according to the driving signal so that the yarns wound on the yarn conveying tray are supplied to the yarn feeder at a selected yarn conveying speed the same as a yarn feeding speed of the circular knitting machine.

3. The yarn conveying system of claim 1, wherein the control unit generates the driving signal based on a set yarn feeding speed to determine the rotational speed of the yarn conveying tray.

4. The yarn conveying system of claim 1, wherein the yarn buffer device outputs a first buffer signal based on tension of the yarns on the yarn conveying path to the control unit to regulate the rotational speed of the yarn conveying tray driven by the driving device.

5. The yarn conveying system of claim 1, wherein the yarn buffer device includes a moving element coupled on each of the yarns and at least one movement detection device to detect positions of the moving element, the movement detection device being electrically connected to the control unit.

6. The yarn conveying system of claim 5, wherein the movement detection device predetermines a movement detection range corresponding to the positions of the moving element and includes a first sensor located at an upper limit of the movement detection range and a second sensor located at a lower limit of the movement detection range; the first sensor or the second sensor generating a second buffer signal to the control unit when the moving element moves beyond the movement detection range.

7. The yarn conveying system of claim 6, wherein the first sensors and the second sensors of different moving elements generate a shut-down signal to the control unit upon detecting the different moving elements respectively moving beyond the upper limit and the lower limit of the movement detection range.

8. The yarn conveying system of claim 6, wherein the movement detection device includes at least one third sensor located between the first sensor and the second sensor, multiple third sensors detecting the positions of different moving elements and sending the detected positions to the control unit, the control unit calculating an average position of all moving elements and comparing with an initial position stored therein to regulate the rotational speed of the yarn conveying tray driven by the driving device.

* * * * *